United States Patent [19]

Akazawa et al.

[11] Patent Number: 5,009,532

[45] Date of Patent: Apr. 23, 1991

[54] PAPER FEEDING APPARATUS FOR ACCOMMODATING DIFFERENT LENGTHS OF RECORDING MEDIA FOR USE WITH A PRINTER

[75] Inventors: Hiroyuki Akazawa, Suwa; Toshihiro Imae, Hino, both of Japan

[73] Assignee: Seiko Epson Corporation, Tokyo, Japan

[21] Appl. No.: 194,667

[22] Filed: May 16, 1988

[30] Foreign Application Priority Data

May 18, 1987 [JP] Japan ..... 62-120717

[51] Int. Cl.[5] ..... B41J 13/03

[52] U.S. Cl. ..... 400/636.2; 400/185; 400/629; 400/605

[58] Field of Search ..... 400/605, 624, 625, 629, 400/636, 636.1, 636.2

[56] References Cited

U.S. PATENT DOCUMENTS

| | | | |
|---|---|---|---|
| 4,248,415 | 2/1981 | Steinhilber | 400/624 X |
| 4,564,187 | 1/1986 | Costa et al. | 400/605 X |
| 4,579,471 | 4/1986 | Hendrischk | 400/605 |
| 4,664,546 | 5/1987 | Rünzi | 400/625 X |
| 4,687,362 | 8/1987 | Rünzi | 400/624 X |
| 4,721,297 | 1/1988 | Katayama | 400/636.2 |
| 4,729,683 | 3/1988 | Staniszewski | 400/624 |
| 4,743,132 | 5/1988 | Chichata et al. | 400/625 X |
| 4,789,259 | 12/1988 | Katayanagi | 400/625 X |
| 4,798,374 | 1/1989 | Ito | 400/625 X |
| 4,812,065 | 3/1989 | Shimogawara et al. | 400/624 |

FOREIGN PATENT DOCUMENTS

| | | | |
|---|---|---|---|
| 202872 | 9/1986 | Japan | 400/624 |
| 205161 | 9/1986 | Japan | 400/624 |
| 30066 | 2/1987 | Japan . | |
| 38259 | 3/1987 | Japan . | |
| 2055763 | 3/1981 | United Kingdom | 400/625 |

*Primary Examiner*—David A. Wiecking
*Attorney, Agent, or Firm*—Blum Kaplan

[57] ABSTRACT

A paper feeding apparatus associated with a printer for storing a plurality of individual recording media and for controlling the release of individual recording media from a storage device toward a platen of the printer. A transmission mechanism couples rotation of the platen in a counterclockwise direction which rotates the paper feeding rollers in a clockwise direction for releasing the individual recording media from the storage device. Rotation of the platen in a clockwise direction halts rotation of the paper feeding rollers preventing further release of individual recording media from the storage device while rotating auxiliary paper feeding rollers in a counterclockwise direction for advancing the individual recording medium toward the platen. A release lever disengages the paper feeding rollers and auxiliary paper feeding mechanism to permit use of continuous print media.

30 Claims, 11 Drawing Sheets

FIG. 12
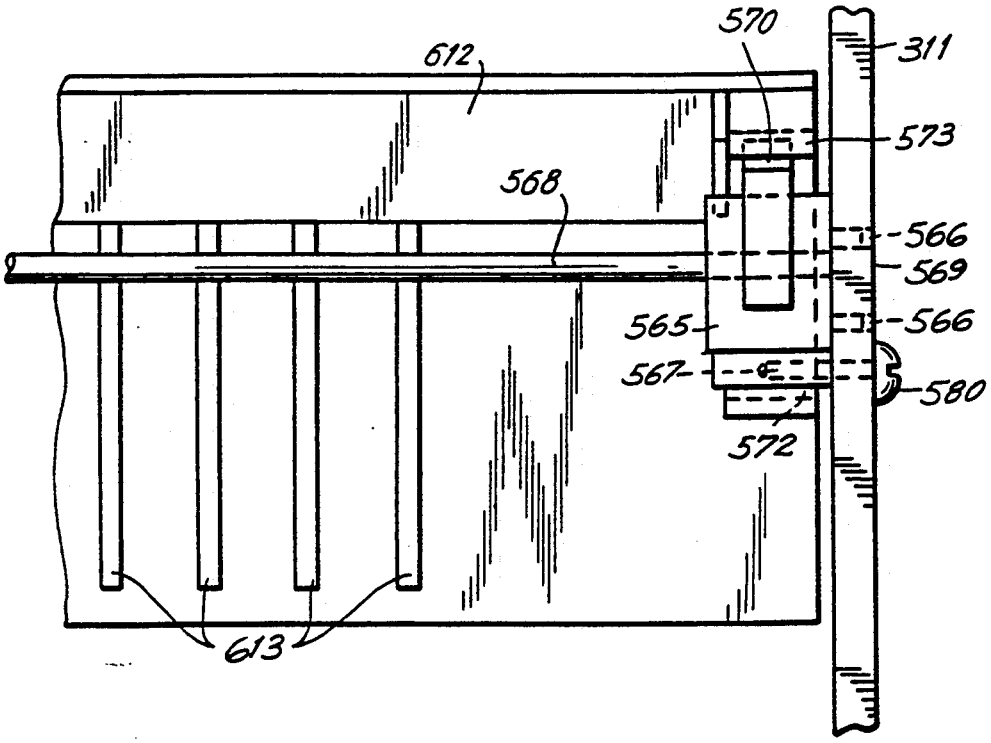
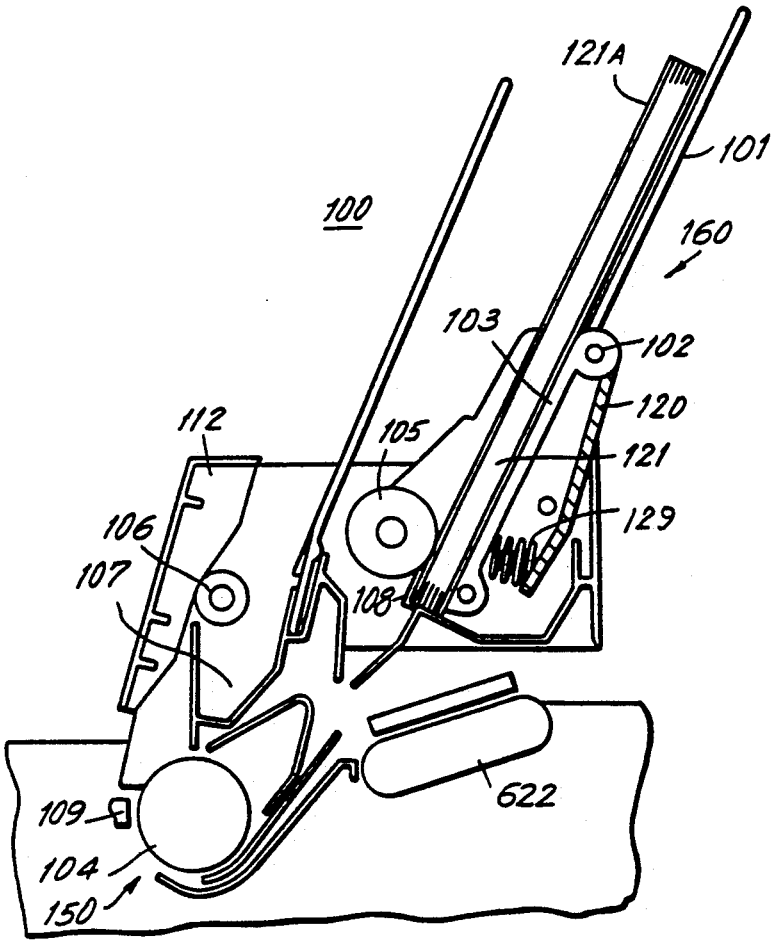
FIG. 13
PRIOR ART

PAPER FEEDING APPARATUS FOR ACCOMMODATING DIFFERENT LENGTHS OF RECORDING MEDIA FOR USE WITH A PRINTER

BACKGROUND OF THE INVENTION

This invention is directed towards a paper feeding apparatus, and more particularly to a paper feeding apparatus for use with a printer.

A conventional paper feeding apparatus is driven by a motor. The motor may also power a platen of a printer or be dedicated to powering only the paper feeding apparatus. FIG. 13 illustrates a device 100 in which a printer 150 has a motor (not shown) which drives both a platen (i.e. printing cylinder) 104 and a paper feeding apparatus 160. Device 100 is disclosed in a Japanese Patent Publication No. 58-6633 published on Feb. 5, 1983; U.S. Pat. No. 4,248,419 is equivalent thereto. Device 100 also includes a paper separation roller 105 and a paper feed-out roller 106. A transmission mechanism (not shown) couples the rotational force of platen 104 to paper separation roller 105 for feeding a top sheet from a stack of papers 121 to platen 104. The transmission mechanism also couples the rotational force of platen 104 to paper feed-out roller 106 for advancing the top sheet beyond a print head 109 and discharging it into a storage section 107.

The stack of papers 121 is loaded into a hopper 101 of paper feeding apparatus 160 by placing the stack on a pressure plate 103. A spring 129 biases pressure plate 103 towards paper feeding roller 105. As platen 104 rotates in a counterclockwise direction, paper feed roller 105 rotates in a clockwise direction and grabs through frictional contact a top sheet 121A from stack of papers 121. A corner of top sheet 121A, which is initially disposed under and pressed against a separation claw 108 of hopper body 101, is dragged over separation claw 108 by paper feeding roller 105. As feed roller 105 continues to rotate, top sheet 121A is released from hopper 101 and advanced by feed roller 105 until in contact with platen 104. Platen 104 now switches directions rotating in a clockwise direction to advance the top sheet between platen 104 and print head 109 for printing by the latter. The top sheet is thereafter discharged into storage section 107 by paper feed-out roller 106.

Conventional paper feeding mechanisms such as apparatus 160 cannot use a single separation device (i.e. separation claw 108) for separating relatively thin paper, envelopes and postcards stacked within hopper 101. Each type of recording medium requires a separating mechanism exclusively for use with that type of recording medium. When a recording medium different from the recording medium presently loaded in apparatus 160 is to be fed into printer 150, the present separating mechanism will either be detached from apparatus 160 and replaced with a new separating mechanism or have additional elements added thereto.

Apparatus 160 also requires a predetermined minimum distance between paper feed roller 105 and platen 104. The distance is equal to the length of the smallest size sheet of paper to be fed into platen 104. Paper having a length less than this minimum distance (e.g. a slip of paper) cannot be adequately advanced by paper feed roller 105 to be properly fed into platen 104. Apparatus 160 also includes a tractor 622 having sprockets (not shown) to feed fanfold paper (e.g. computer paper) into printer 150. Storage section 107, however, is too small to hold the fanfold paper.

The angle at which the sheet 121A from the stack of papers 121 contacts separation claw 108 changes as the height of the stack decreases due to pressure plate 103 rotating about a shaft 102. A space (i.e. gap) between claw 108 and the top sheet is created when the height of the stack drops below a certain level. Individual sheets from the stack of papers 121 are no longer individually removed by paper feed roller 105. Instead, platen 104 attempts to advance more than one sheet at a time through printer 150. Wrinkling and/or other deformation of the sheets and/or jamming of printer 150 can result.

It is therefore desirable to provide a paper feeding apparatus which can feed different lengths of recording media into the platen of the printer, which can accommodate fanfold paper and which prevents the feeding of more than one sheet of paper into the platen no matter how depleted the stack of papers may be within the hopper. Preferably, the paper feeding apparatus should feed sheets of paper into the platen having lengths as short as about 80 millimeters. No additional or different attachments should be required for feeding individual sheets of paper, envelopes, postcards or the like into the platen.

SUMMARY OF THE INVENTION

Generally speaking, in accordance with one aspect the invention, a paper feeding apparatus associated with a printer having a platen includes a motor for rotating the platen in clockwise and counterclockwise directions and a pair of hoppers for holding a plurality of individual recording media. The hoppers each include a separating mechanism for controlling the release of individual recording media therefrom. The paper feeding apparatus also includes one or more paper feed rollers for removing individual recording media from the hoppers and one or more auxiliary paper feed rollers disposed along a path along which the individual recording media travel. The one or more auxiliary rollers are positioned between the paper feed rollers and platen for advancing the individual recording media towards the platen.

A transmission mechanism rotates the paper feed rollers only in response to rotation of the platen in a counterclockwise direction. The transmission mechanism, however, is coupled to the auxiliary paper feed rollers so that rotation of the platen in either a clockwise or counterclockwise direction will cause auxiliary paper feed rollers to rotate in a counterclockwise direction.

By rotating the platen in a counterclockwise direction, individual recording media can be removed from the hoppers. Once released from the hoppers, the platen can rotate in either a counterclockwise or clockwise direction for advancing the individual recording media towards the platen due to the counterclockwise rotation of the auxiliary paper feed rollers. If the platen continues to rotate in a counterclockwise direction, a continuous stream of individual recording media will be released from the hoppers and advanced towards the platen by the auxiliary paper feed rollers. If the platen begins to rotate in a clockwise direction once the first individual recording media is released from the hopper, the one or more paper feed rollers will cease rotating. Consequently, only the first individual recording media will be advanced by the auxiliary paper feed rollers towards the platen.

In accordance with another aspect of the invention, a release lever can decouple the transmission mechanism from the one or more paper feed rollers and auxiliary paper feed rollers. When in this decoupled mode, fanfold paper can be advanced toward the platen without interference from the recording media stored in the hoppers.

In accordance with a further aspect of the invention, a paper feed-out guide is provided which can be pivoted to change the discharge path of the recording media. In a first position, the recording media from the hoppers is directed towards a storage section of the apparatus. In a second position, the recording media is directed away from the storage section to accommodate the discharge of fanfold paper from the printer.

Accordingly, it is an object of the invention to provide an improved paper feeding apparatus which separates and releases individual recording media from a pair of hoppers using a single separating mechanism requiring no detachment or attachment of parts.

It is another object of the invention to provide an improved paper feeding apparatus in which the stack of recording media need not be maintained at a predetermined minimum height to ensure the removal of individual recording media from the hoppers.

It is a further object of the invention to provide a paper feeding apparatus which can properly feed individual recording media to a platen of a printer having lengths as small as about 80 millimeters.

It is still another object of the invention to provide an improved paper feeding apparatus which can switch the direction along which the recording media travels as it is discharged from a printer.

It is still a further object of the invention to provide an improved paper feeding apparatus which permits the use of fanfold paper by a printer.

Still other objects and advantages of the invention will in part be obvious and will in part be apparent from the specification.

The invention accordingly comprises the several steps in a relation of one or more of such steps with respect to each of the others, and the apparatus embodying features of construction, a combination of elements, and arrangements of parts which are adapted to effect such steps, all is exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIG. 12 is a fragmented front elevational view of the feed-out guide; and

FIG. 13 is a diagrammatic side elevational view, partially in cross section, of a prior art paper feeding apparatus attached to a printer.

DETAILED DESCRIPTION OF THE PREFERRED EMBODIMENT

Figure 1:
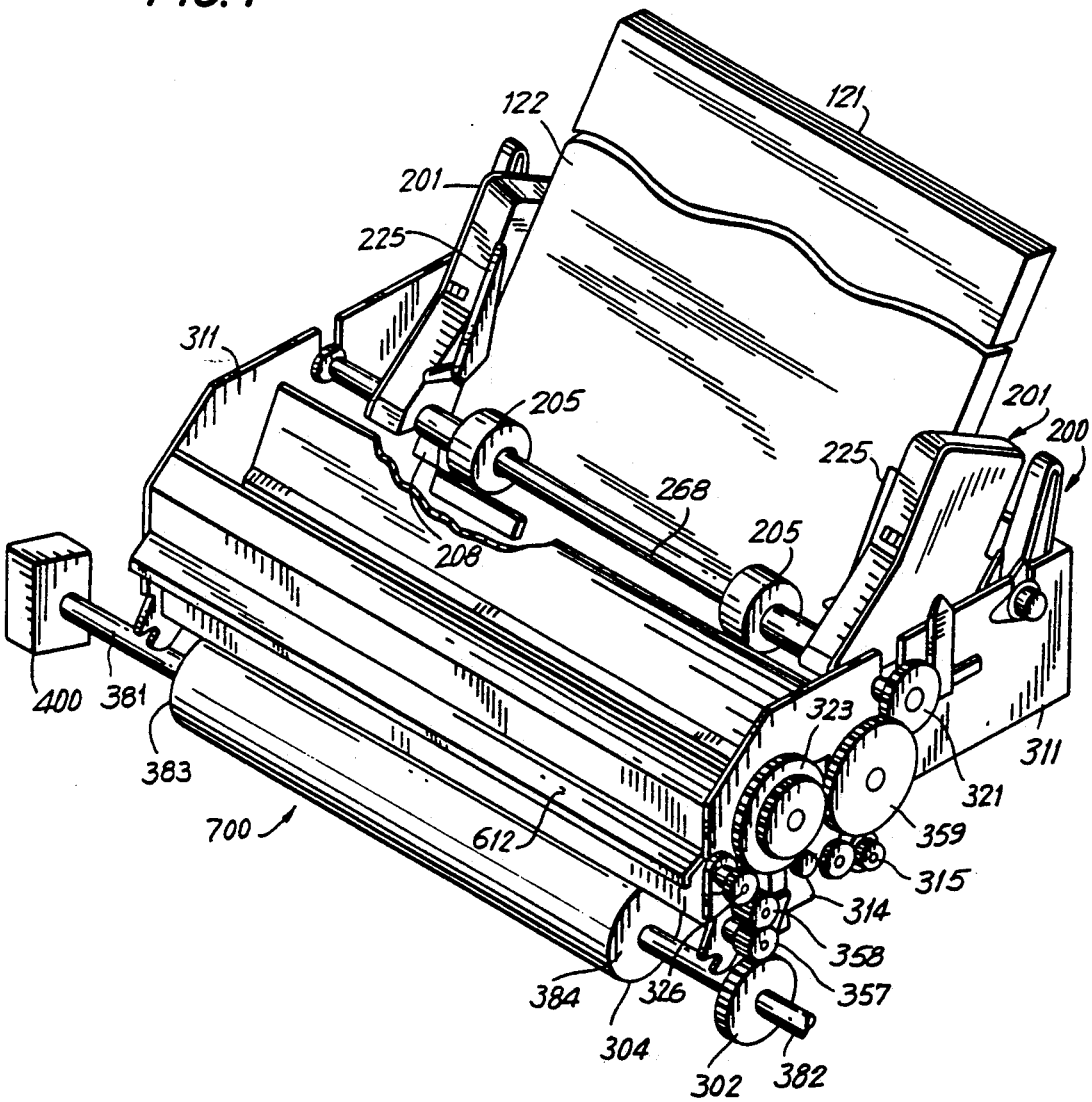
FIG. 1 is a perspective view of a printer and a paper feeding apparatus in accordance with the preferred embodiment of the invention.
Figure 2:
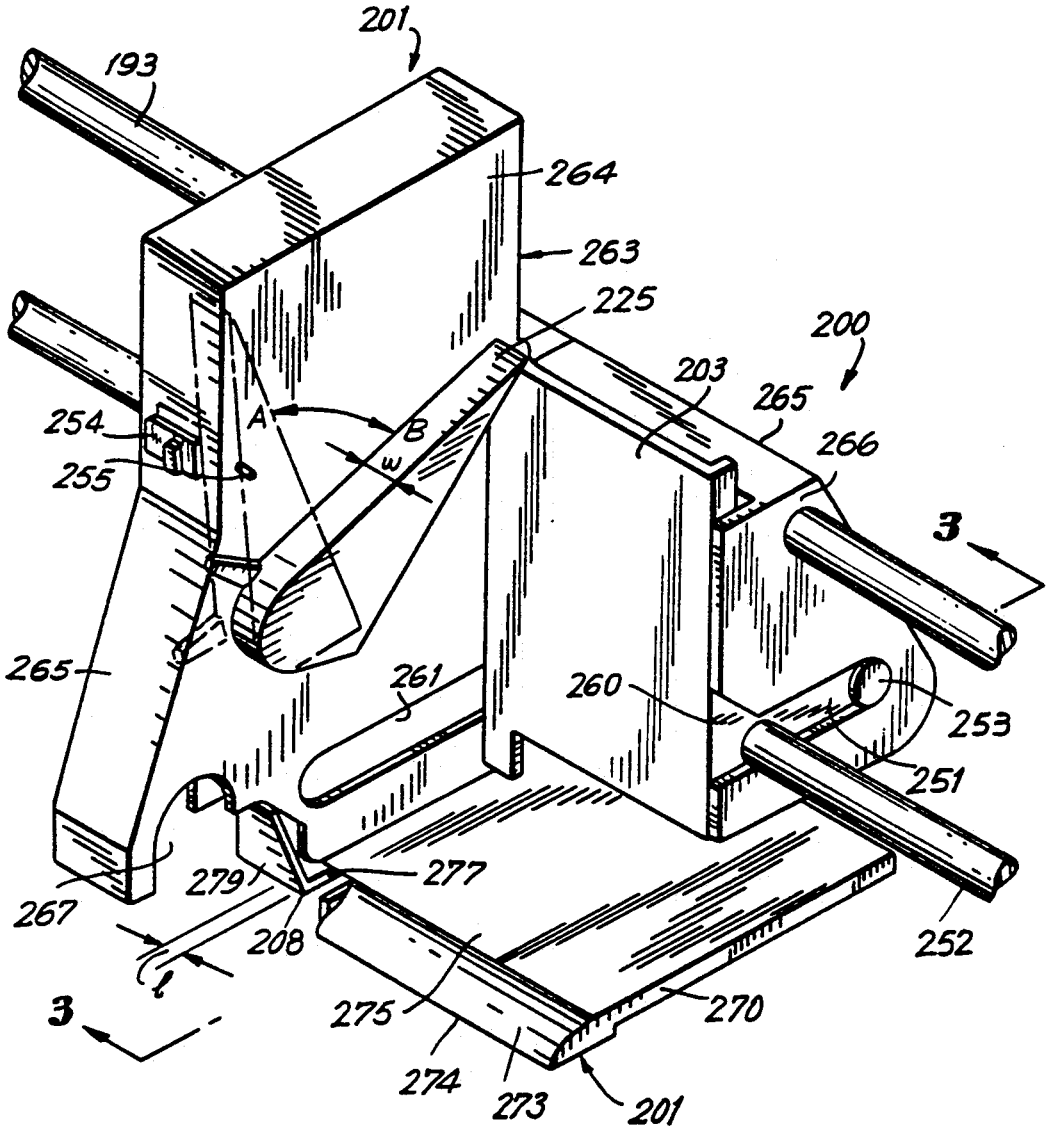
FIG. 2 is a perspective view of one of two hoppers of the paper feeding apparatus.
Figure 3:
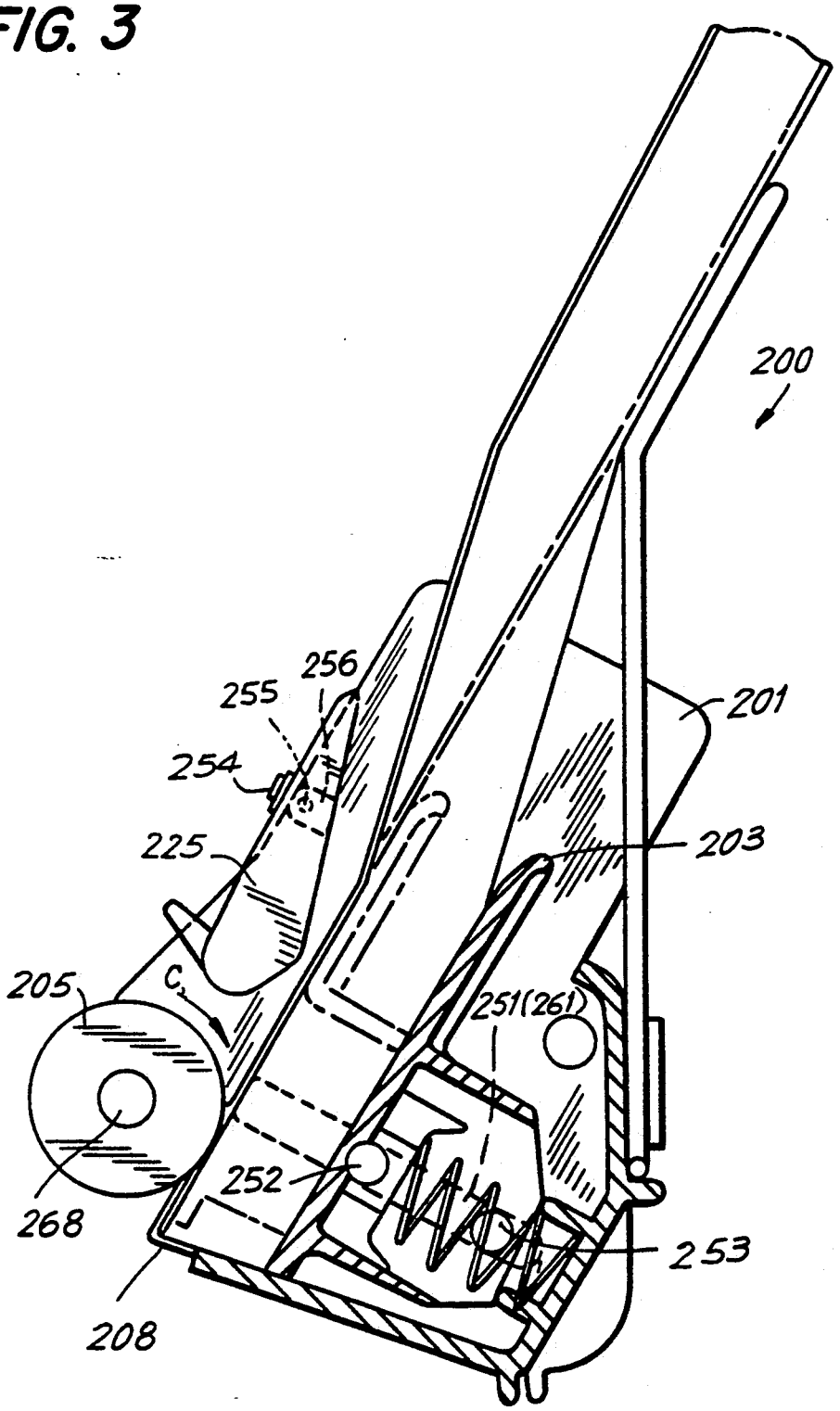
FIG. 3 is a cross-sectional view of FIG. 2 taken along lines 3—3.

As shown in FIGS. 1, 2 and 3, a paper feeding apparatus 200 includes a pair of hoppers 201 which support a pair of pressure plates 203 for holding various types of recording media and biasing such recording media towards a pair of paper feed rollers 205. Pressure plates 203 each include a guide pin 253 extending from a side wall 260. Each hopper 201 includes a side wall 263, a rear wall 265 and a bottom wall 270 and is slidably supported by a shaft 193. Side wall 263, rear wall 265 and bottom wall 270 of each hopper 201 extend in substantially perpendicular directions to each other. Side wall 263 is formed with an elongated opening 261. A guide shaft 252 extends between hoppers 201, travels through each pressure plate 203 and enters opening 261 of each side wall 263. Rear wall 265 includes an extension 266 integral with and protruding in a direction perpendicular thereto. Extension 266 also includes an elongated opening 251. Side wall 263 and extension 266 extend in substantially parallel planes. Shaft 252 slides within openings 251 and 261. Pin 253 slides within opening 251. A pair of compression spring coils 250 press against pressure plates 203 for biasing pressure plates 203 towards the pair of paper feed rollers 205. Each pressure plate 203 travels in linear reciprocating directions guided by shaft 252 and pin 253 riding within opening 251 and by shaft 252 riding within opening 261.

Bottom wall 270 includes a beveled surface 273 sloping downwardly from an interior planar surface 275. Connected to each bottom wall 270 is a claw 208 having a substantially L-shaped cross-section with a pair of legs 277 and 279. Leg 277 extends in the same plane as interior surface 275 of bottom wall 270. Leg 279 and pressure plate 203 extend in substantially parallel planes. Each side wall 263 also includes an interior surface 264 and an adjusting arm 225 which is rotatably connected to interior surface 264. A bar-like member 254 protrudes from a top surface 265 of each side wall 263 and is slidably connected to side wall 263. Bar-like member 254 includes a pin member 255 which can slide through an opening (not shown) of interior surface 264 so as to protrude from the latter. In its protruding position, pin 255 intersects the path along which arm 225 travels. Each arm 225 includes a groove 256. Arm 225 rotates in counterclockwise and clockwise directions denoted by a pair of arrows A and B, respectively. Pin 255 can be slid into groove 256 by rotating arm 225 in a direction denoted by arrow A to a position represented by the dot-dash lines. With pin member 255 engaged by groove 256, bar-like member 254 serves as a stopper to prevent arm 225 from moving towards pressure plate 203. Side wall 263 also includes a substantially U-shaped opening 267 through which a shaft 268 extends for rotatably supporting paper feed rollers 205.

A plurality of individual, unconnected (i.e. cut) sheets of paper 121 stacked together are supported by pressure plate 203. Hoppers 201 slide along shaft 193 to position side walls 263 adjacent to the lengthwise edges of the sheets. The sheets are then properly aligned along their lengthwise edges. The edges of the sheets along their widths are adjacent to and rest on interior surface 275 of bottom wall 270. With arms 225 prevented from moving towards pressure plate 203 by corresponding pins 255 extending into grooves 256, pressure plates 203 press the stack of papers 121 towards paper feed rollers 205. A top sheet 122 of the stack of papers 121 is disposed under and in contact with claws 208.

As paper feed rollers 205 rotate in a clockwise direction as denoted by an arrow C in FIG. 3, they grab and draw top sheet 122 from hoppers 201. The corners of top sheet 122 which are disposed under and in contact with claws 208 bend (i.e., buckle) as they are dragged over claws 208. The next most top sheet in the stack of papers 121 is then caught and held by claws 208. Only one sheet of paper 121 at a time is separated from the stack and released from hoppers 201.

When relatively thick recording media such as, but not limited to, envelopes and postcards are placed in paper feeding apparatus 200, pin member 255 of bar-like member 254 is slidably removed from groove 256 of each arm 225. With pin members 255 no longer protruding beyond interior surfaces 264 of side walls 263, each arm 225 due to gravity, a spring or other biasing device rotates towards one of the two pressure plates 203. The comparatively thick recording media is pressed against pressure plates 203 by arms 225.

Figure 6:
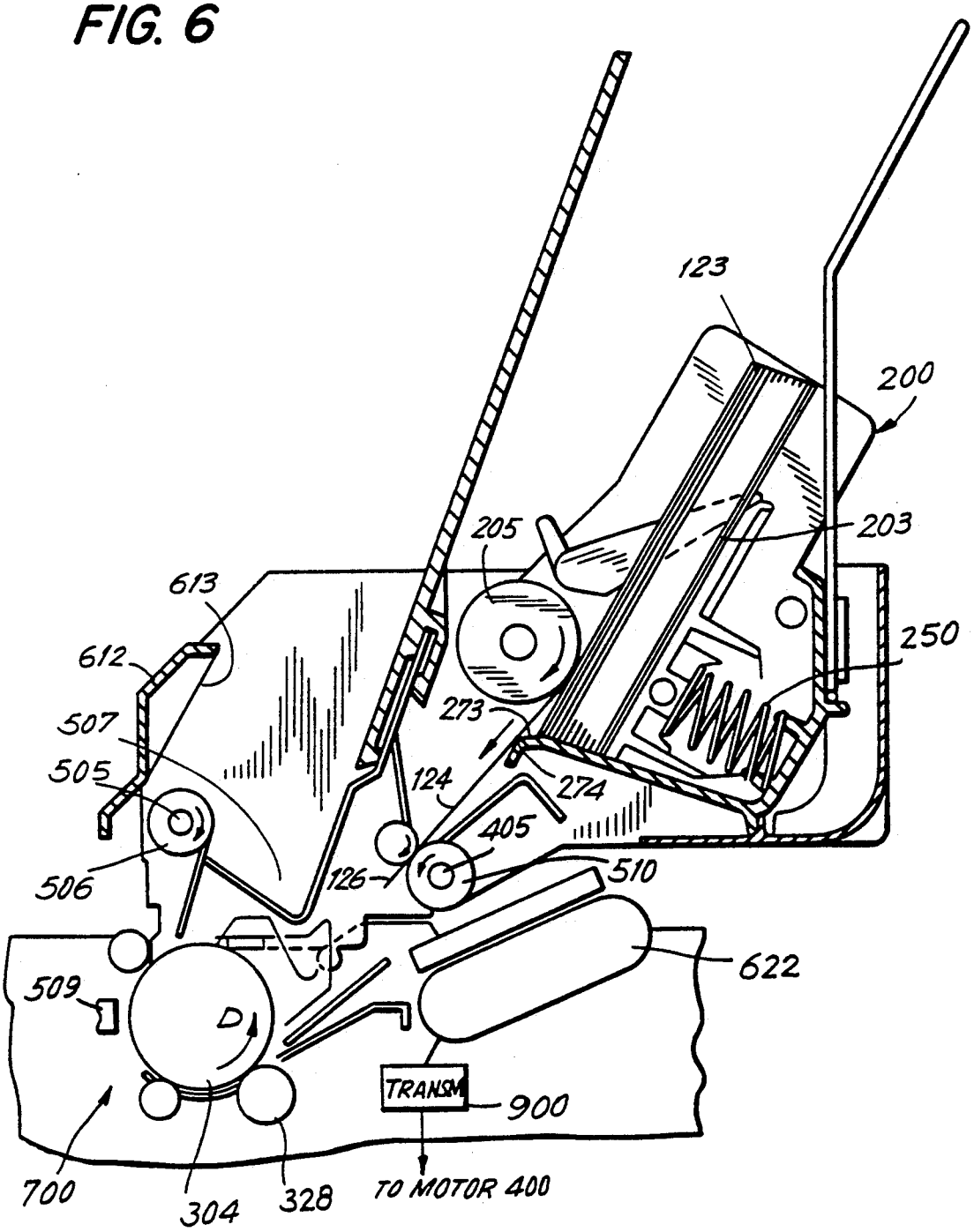
FIGS. 6, 7 and 8 are diagrammatic side elevational views, partially in cross-section, of FIG. 1 illustrating the path of travel by a sheet of the recording media through the printer and paper feeding apparatus.

As shown in FIG. 6, a top sheet 124 (e.g. envelope, postcard, or the like) of a stack of recording media 123 is separated therefrom by being pushed onto beveled surface 273. More particularly, due to the inclined surface of pressing plate 203 and the bias force provided by compression spring coil 250, top sheet 124 is disposed along an edge 274 of beveled surface 273. Rotation of paper feeding rollers 205 in a clockwise direction draws top sheet 124 off beveled surface 273. As the amount of paper 123 decreases, pressure plate 203 moves closer to paper feeding rollers 205 with arms 225 pivoting to maintain recording media 123 stacked together.

Referring momentarily to FIG. 2, a portion of legs 277 and 279 of each claw 208 has a length "1" which extends inwardly past interior surface 264 of side wall 263. Arm 225 has a width "w" which is greater than length 1 of claw 208. Length 1 is dimensioned to ensure that only the top most sheet of relatively thin paper can be separated from the remaining stack of papers 121. Length 1 of each claw 208, however, is too long to permit comparatively thicker recording media 123 from being individually separated by claws 208. In particular, length 1 of each claw 208 requires that a high bending (i.e., buckling) force be exerted at the corners of top sheet 124 to drag it over claws 208 and thereby release it from hoppers 201. Claws 208 are therefore unsuitable as a separating mechanism for recording media 123.

Referring once again to FIG. 1, a pair of shafts 381 and 382 (or one continuous shaft) extend along the axis of and protrude from a pair of side surfaces 383 and 384 of a platen 304 of a printer 700, respectively. Shaft 381 is coupled to a motor 400 which provides the driving force to rotate platen 304 in both counterclockwise and clockwise directions. Shaft 382 rotates in the same direction as platen 304. A platen gear 302 is attached to shaft 382. Platen gear 302 is part of a gear train mechanism 300 which transmits the rotary motion of motor 400 to several different rollers, including paper feed rollers 205.

Figure 4A:
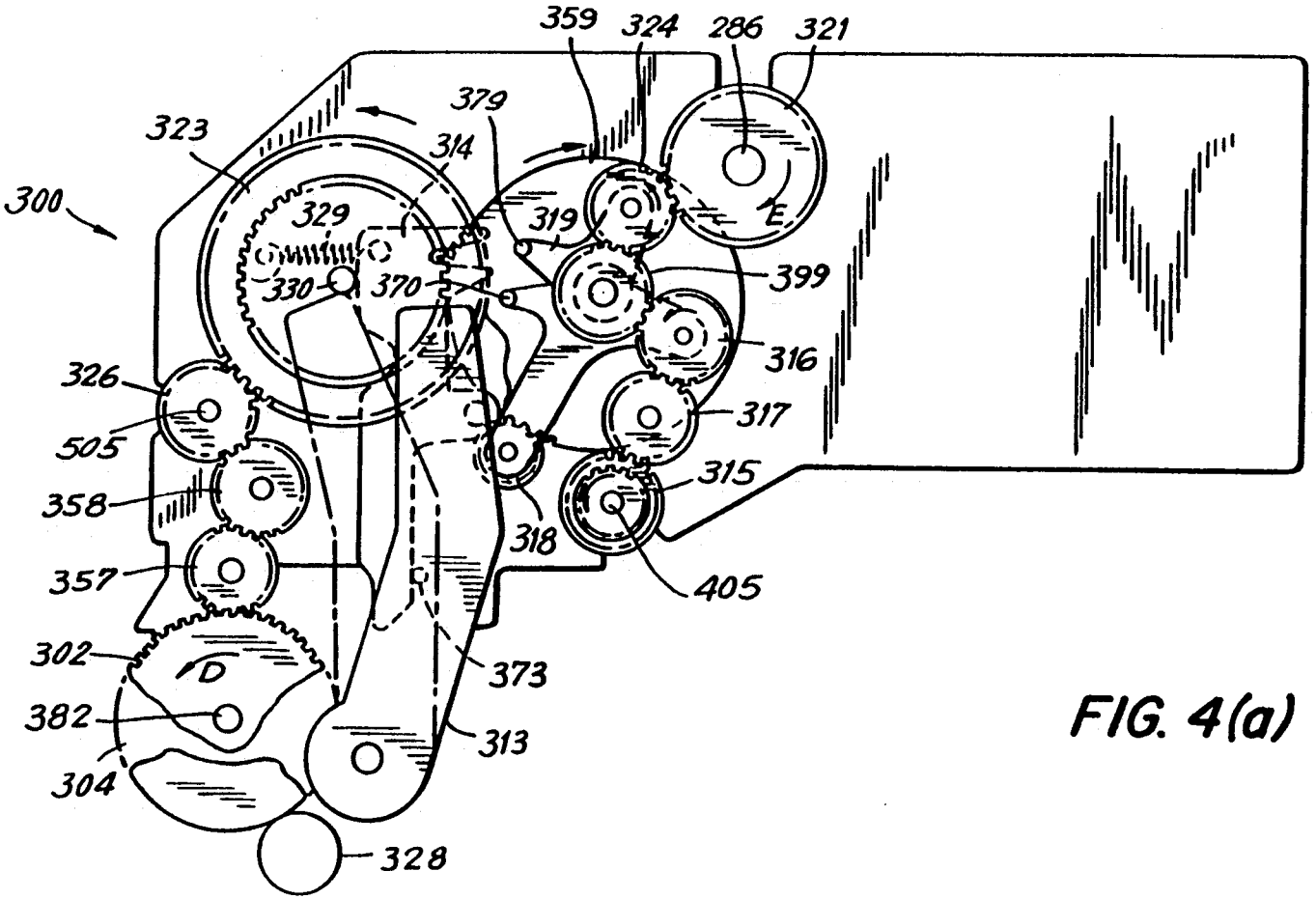
FIGS. 4(*a*) and 4(*b*) are side elevational views of a gear train mechanism of FIG. 1 with a release lever in a first position.
Figure 4B:
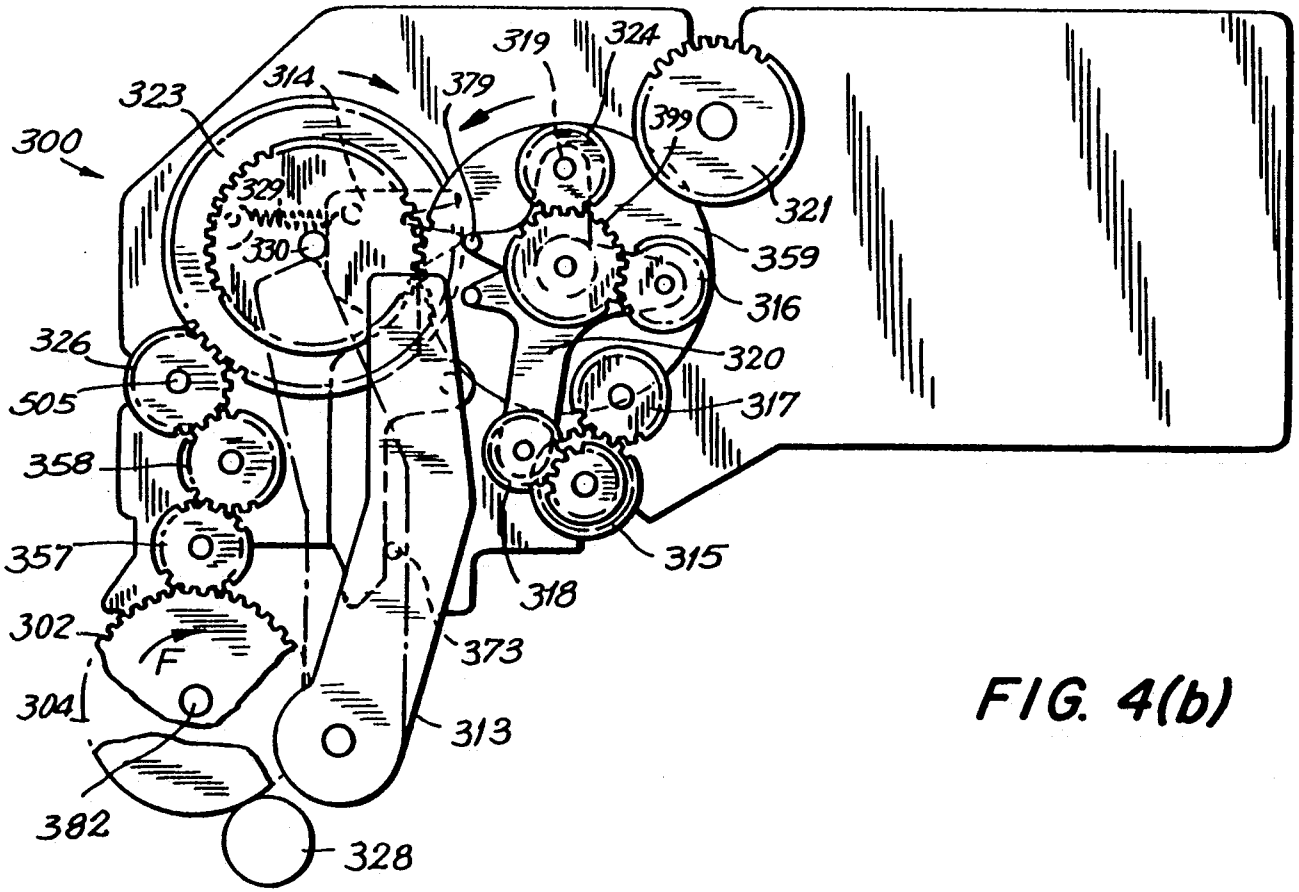

As shown in FIG. 4(*a*), gear train mechanism 300 with platen 304 rotating in a counterclockwise direction as denoted by an arrow D causes platen gear 302 to also rotate in the direction of arrow D. Gear train mechanism 300 includes platen gear 302 which engages a first drive gear 357 which in turn engages a second drive gear 358. A paper feed-out gear 326 meshes with second drive gear 358 and a large intermediate gear 323 which in turn engages a second large gear 359. As platen gear 302 rotates in counterclockwise direction D, first drive gear 357, paper feed-out gear 326 and second large gear 359 also rotate in a clockwise direction and second drive gear 358 and first large gear 323 rotate in a counterclockwise direction. A sun gear 399 is fixed to and rotates in the same direction as second large gear 359. A planet lever 320 having two short arms and one long arm and two planet fingers 370 and 379 pivots coaxially second large gear 359 at a predetermined frictional torque. An upper planet gear 316 engaged with sun gear 399 and a lower planet gear 318 are rotatably supported at distal ends of planet lever 320. Planet gear 318 meshes with gear 359.

An additional planet lever 319 pivots coaxially with second large gear 359 at a predetermined frictional torque. Located at a distal end of planet lever 319 is a planet gear 324. Planet gear 316 and a planet gear 324 mesh with sun gear 399. As sun gear 399 rotates in a clockwise direction due to the counterclockwise rotation of platen gear 302, planet gears 324 and 316 rotate in counterclockwise directions. A paper feed gear 321 mounted on a paper feed shaft 286 is engaged by planet gear 324 and rotates in a clockwise direction as denoted by an arrow E. Paper feed rollers 205 are mounted on shaft 286 and rotate in clockwise directions for drawing individual sheets from the stack of papers 121 or recording media 123 stored in hoppers 201 as platen 304 rotates in a counterclockwise direction.

At the same time, lower planet gear 316 engages with an auxiliary drive gear 317 which in turn engages with an auxiliary paper feed gear 315. As shown between FIGS. 4(*a*) and 6, auxiliary paper feed gear 315 is mounted on a shaft 405 which rotates one or more auxiliary paper feed rollers 510. The counterclockwise rotary motion of lower planet gear 316 causes auxiliary drive gear 317 to rotate in a clockwise direction and auxiliary paper feed gear 315 to rotate in a counterclockwise direction. Therefore, as platen 304 rotates in a counterclockwise direction, auxiliary paper feed rollers 510 also rotate in a counterclockwise direction.

As shown in FIG. 6, auxiliary paper feed rollers 510 are located between paper feed rollers 205 and platen 304 and along the path traveled by recording media 123. When paper feed rollers 205 rotate in a clockwise direction and auxiliary paper feed rollers 510 rotate in a counterclockwise direction, top sheet 124 of recording media 123 is drawn from hoppers 201 and properly fed about platen 304.

As shown in FIG. 4(*b*), when platen 304 is rotated in a clockwise direction denoted by an arrow F, sun gear 399 is rotated in a counterclockwise direction and planet lever 320 is pivoted in the counterclockwise direction thereby moving upper planet gear 324 out of engagement with paper feed gear 321. At the same time, lower planet gear 316 moves out of engagement with auxiliary drive gear 317. Bottom planet gear 318, which engages second large gear 359, now moves into engagement and meshes with auxiliary paper feed gear 315. Rotation of gear 359 in a counterclockwise direction causes gear 318 to rotate in a clockwise direction which in turn causes bottom planet auxiliary paper feed gear 315 to rotate in a counterclockwise direction. In other words, as platen 304 rotates in a clockwise direction, auxiliary paper feed rollers 510 rotate in a counterclockwise direction. Paper feed rollers 205 are now stationary with upper planet gear 324 disengaged from paper feed gear 321. Accordingly, top sheet 124 cannot be drawn from hoppers 201 during clockwise rotation of platen 304. If top sheet 124 was already drawn from hoppers 201 it will advance towards platen 304 due to the counterclockwise rotation of auxiliary paper feed rollers 510.

Figure 7:
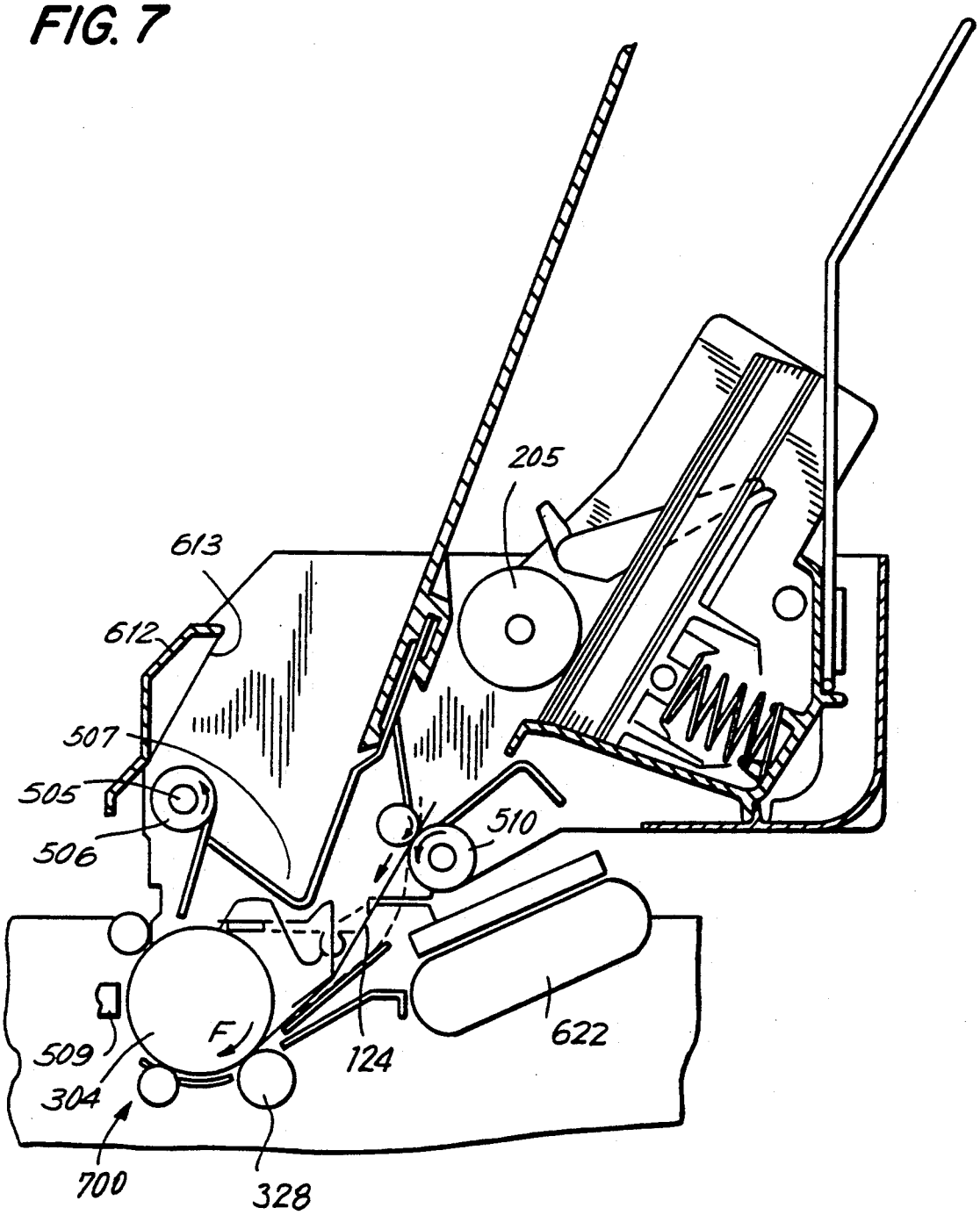
Figure 8:
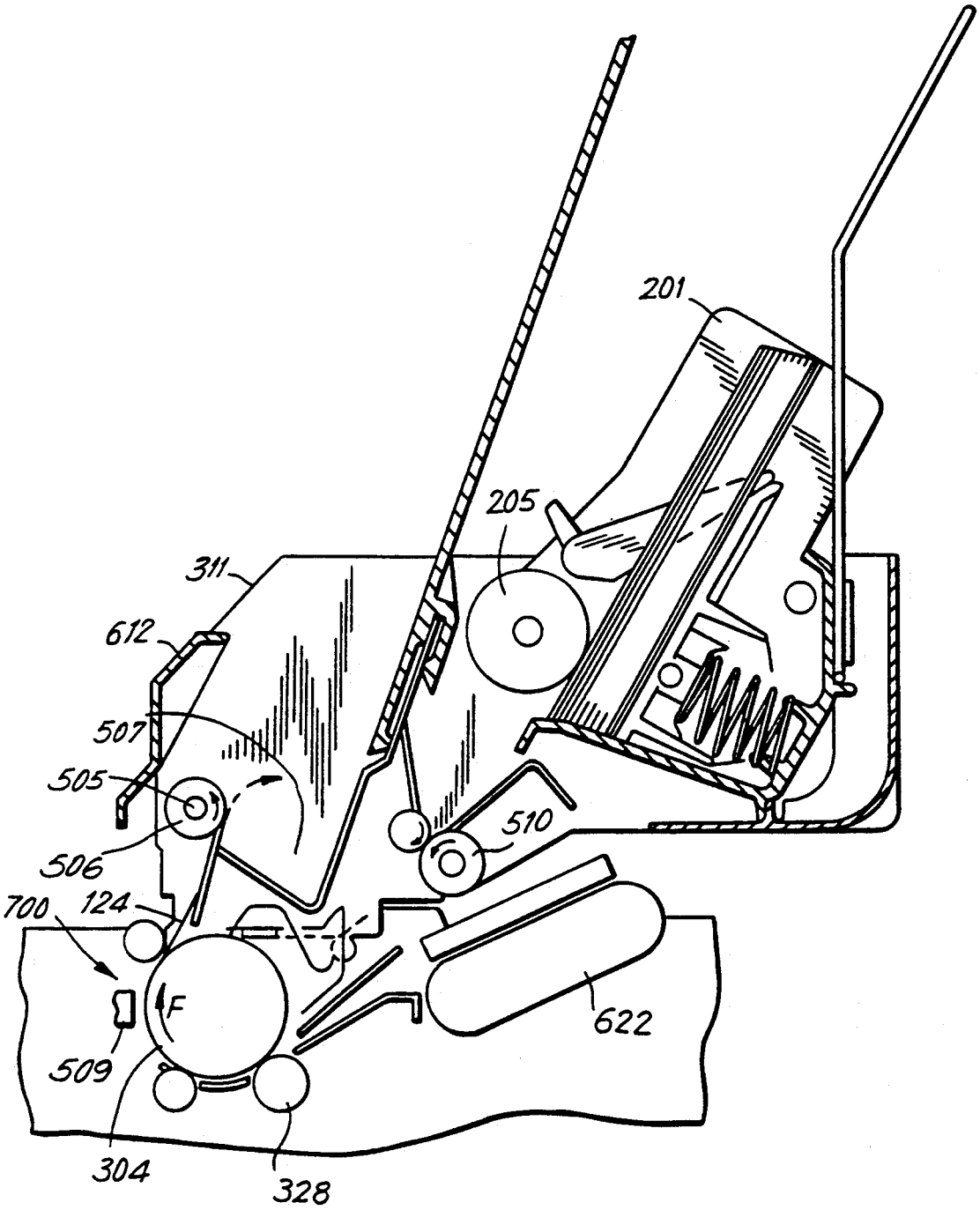

As shown in FIGS. 6-8, top sheet 124 is initially drawn from hoppers 201 when platen 304 is rotated in a counterclockwise direction D. As a leading edge 126 of top sheet 124 is drawn over auxiliary paper feed rollers 510, platen 304 is rotated in clockwise direction F which disengages upper planet gear 324 from paper feed gear 321. Accordingly, no additional sheets, envelopes, postcards or the like of recording media from hoppers 201 are released at this time. Continued clockwise rotation of platen 304 causes auxiliary paper feed rollers 510 to continue to rotate in a counterclockwise direction permitting top sheet 124 to advance towards platen 304.

Just before leading edge 126 of top sheet 124 contacts platen 304, the rotating directions of platen 304 is reversed to a slight rotation in the counterclockwise direction D. Leading edge 126 is slightly bent so as to be properly positioned between platen 304 and a lower paper feed roller 328. Alternatively, leading edge 126 of top sheet 124 can be allowed to contact platen 304 initially. Platen 304 rotates in counterclockwise direction D to ensure that sheet 124 is bent and properly aligned between platen 304 and paper feed roller 328.

Platen 304 is then rotated in clockwise direction F advancing sheet 124 between a print head 509 and platen 304. After a first line of print has been completed, platen 304 is rotated in clockwise direction F until top sheet 124 advances to the next line to be printed. The staggered clockwise rotation of platen 304 continues until all lines of print have been recorded on sheet 124. Top sheet 124 is then fed into paper feed-out rollers 506 which advance and deposit top sheet 124 to a storage section 507 of paper feeding apparatus 200.

Paper feed-out gear 326 is mounted on a shaft 505 having paper feed-out rollers 506 rotatably mounted thereon. Rotation of platen 304 in a clockwise direction causes paper feed-out gear 326 to rotate in a clockwise direction. Therefore, as platen 304 rotates in a clockwise direction paper feed-out rollers 506 also rotate in a clockwise direction which advances top sheet 124 into storage section 507.

The foregoing sequence of steps in removing top sheet 124 from hoppers 201, feeding top sheet 124 into platen 304, and advancing top sheet 124 through printer 700 into storage section 507 can be repeated for each sheet, envelope, postcard and the like placed in hoppers 201. Paper feed apparatus 200 can accommodate sheets of paper having a relatively large width relative to their length such as slips of paper (e.g. having a length of approximately 80 millimeters). Paper feeding apparatus 200 also ensures that each sheet of recording media is individually fed from hoppers 201 into platen 304. Additionally, no other attachments are necessary to accommodate comparatively thicker sheets of paper, envelopes, postcards and the like.

Referring once again to FIG. 4(*a*), when recording media (i.e., cut sheets of paper, envelopes, post cards or the like) are stored in hoppers 201, a release lever 313 is positioned to permit paper feed roller 328 to press against platen 304. A tractor 622 for advancing fanfold paper (e.g. computer paper) toward platen 304, shown in FIG. 6, is decoupled from motor 400 through a transmission mechanism 900. Consequently, fanfold paper is not advanced by tractor 622 with release lever 313 in its upright position as shown in FIG. 4(*a*). When fanfold paper is to be fed into platen 304, release lever 313 is rotated slightly in a counterclockwise direction to the position shown in FIG. 5. Paper feed roller 328 is now disengaged from platen 304.

Gear train mechanism 300 also includes an adjusting lever 314 which is rotatably attached to side walls 311 by a shaft 394 and has a downwardly extending engaging portion 393 having an inwardly facing pin 373 mounted thereon. As release lever 313 is rotated counterclockwise, pin 373 contacts and presses against engaging portion 393 of adjusting lever 314. Adjusting lever 314 continues to rotate until the back of a pair of grooves 390 and 391 engage planet fingers 370 and 379 on planet lever 320. Displacement of adjusting lever 314 clockwise towards planet lever 320 causes planet lever 320 to pivot about shaft 394 so that planet gears 324, 318 and 316 are disengaged from with paper feed gear 321, auxiliary paper feed gear 315 and gear 317, respectively. The driving force from motor 400 is no longer transmitted to paper feed rollers 205 or auxiliary paper feed rollers 510. Clockwise rotation of platen 304 will not draw any recording media from hoppers 201 by paper feed rollers 205. Rotation of platen 304 in a clockwise or counterclockwise direction will not advance any recording media from hoppers 201 towards platen 304 by auxiliary paper feed roller 510. Therefore, only fanfold paper can be fed into platen 304 with release lever 313 displacing adjusting lever 314 as shown in FIG. 5.

Figure 5:
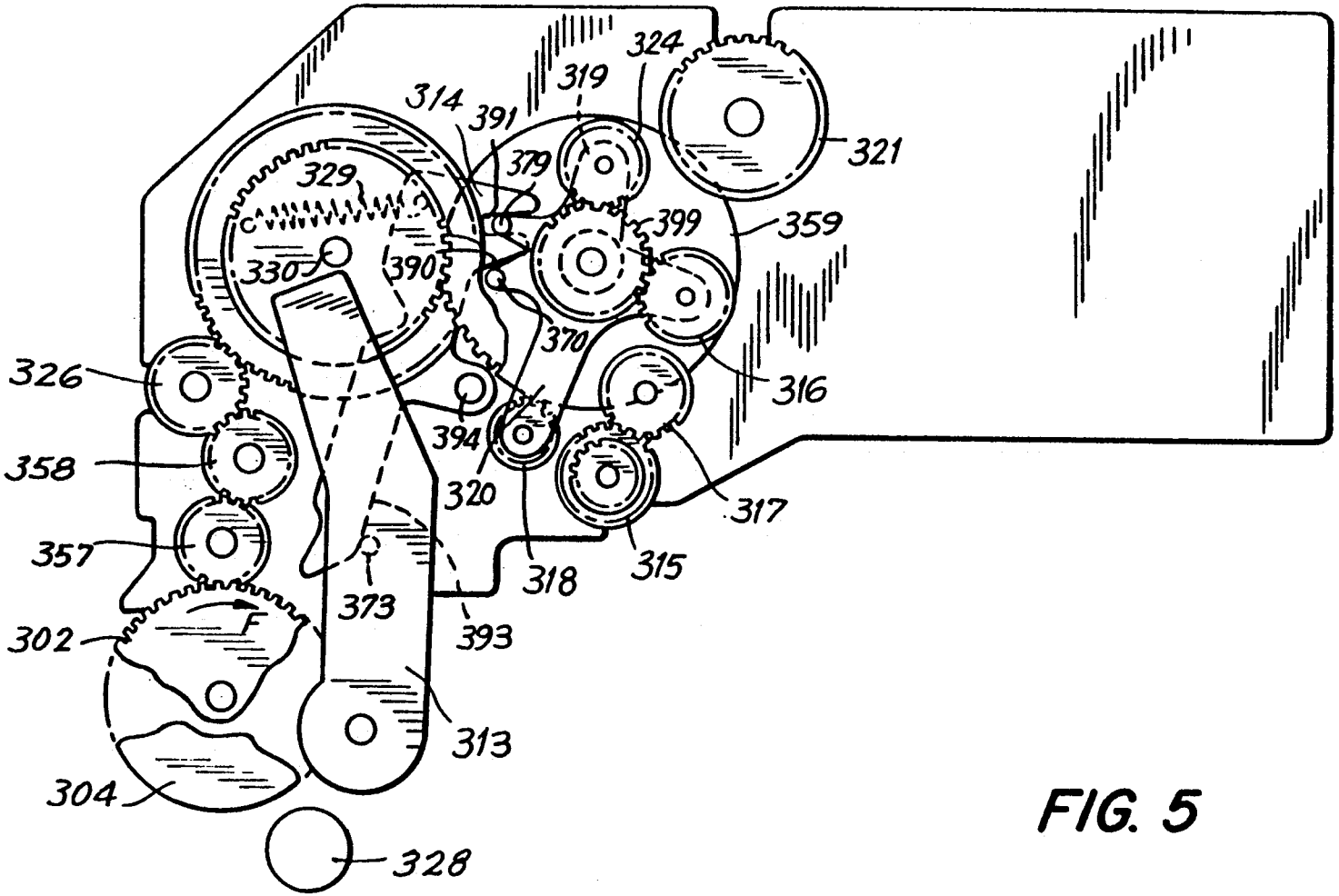
FIG. 5 is a side elevational view of the gear train mechanism of FIG. 1 with the release lever in a second position.

When paper feeding apparatus 200 is returned from the fanfold paper mode to the cut sheet paper mode, release lever 313 is rotated clockwise from the position in FIG. 5 to its position in FIG. 4(*a*). Paper feed roller 328 once again presses against platen 304. As release lever 313 is rotated in a clockwise direction, pin 373 releases displacement of adjusting lever 314 which is pivoted counterclockwise by return spring 329. Adjusting lever 314 rotates away from and is no longer in contact with pins 370 and 379. Continued counterclockwise rotation by adjusting lever 314 is prevented by a stopper 330.

As shown in FIGS. 9, 10, 11 and 12, a paper feed-out guide 612 having a plurality of ribs 613 positioned over platen 304 guides removal of fanfold paper from printer 700. A pair of grooves 672 and 673 of paper feed-out guide 612 are formed on the interior surface of paper feed-out guide 612. Paper feed-out guide 612 is rotatably mounted on a shaft 568 mounted on side frames 311. A paper feed-out guide lock 565 is fixed to side frames 311 by screws 580. Each screw 580 is threaded into a screw fixing hole 567 within a lower circular portion 595 of guide lock 565. An opening 569 on each side frame 311 is dimensioned to be greater than the diameter of shaft 568 so that shaft 568 freely rotates within opening 569. Paper feed-out guide lock 565 also includes an arc-shaped arm 590 having a distal end 570. A protrusion 571 extends above distal end 570.

Figure 9:
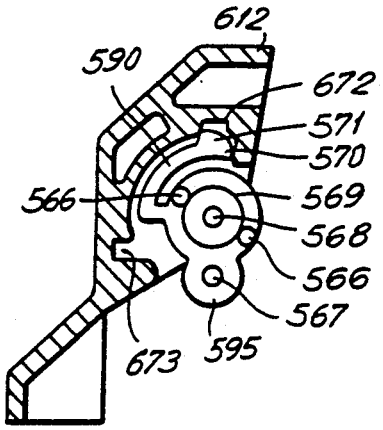
FIG. 9 is a sectional view of a feed-out guide for directing the discharge of the recording media in a first direction.

As shown in FIGS. 8 and 9, when paper feeding apparatus 200 feeds out sheets of paper, envelopes, postcards or the like from hoppers 201, paper feed-out guide 612 is rotatably locked into a first position by protrusion 571 extending into groove 672. The recording media from printer 700 is advanced by paper feed-out roller 506 and fed into storage section 507.

Figure 10:
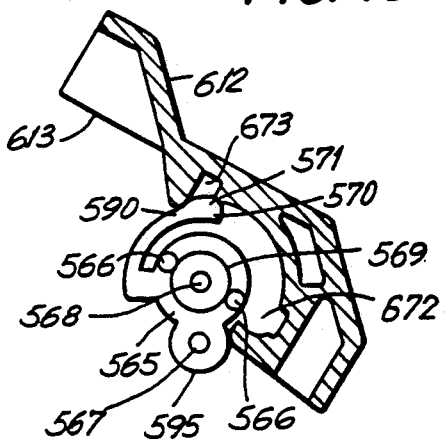
FIG. 10 is a sectional view of the feed-out guide for directing the discharge of the recording media in a second direction.
Figure 11:
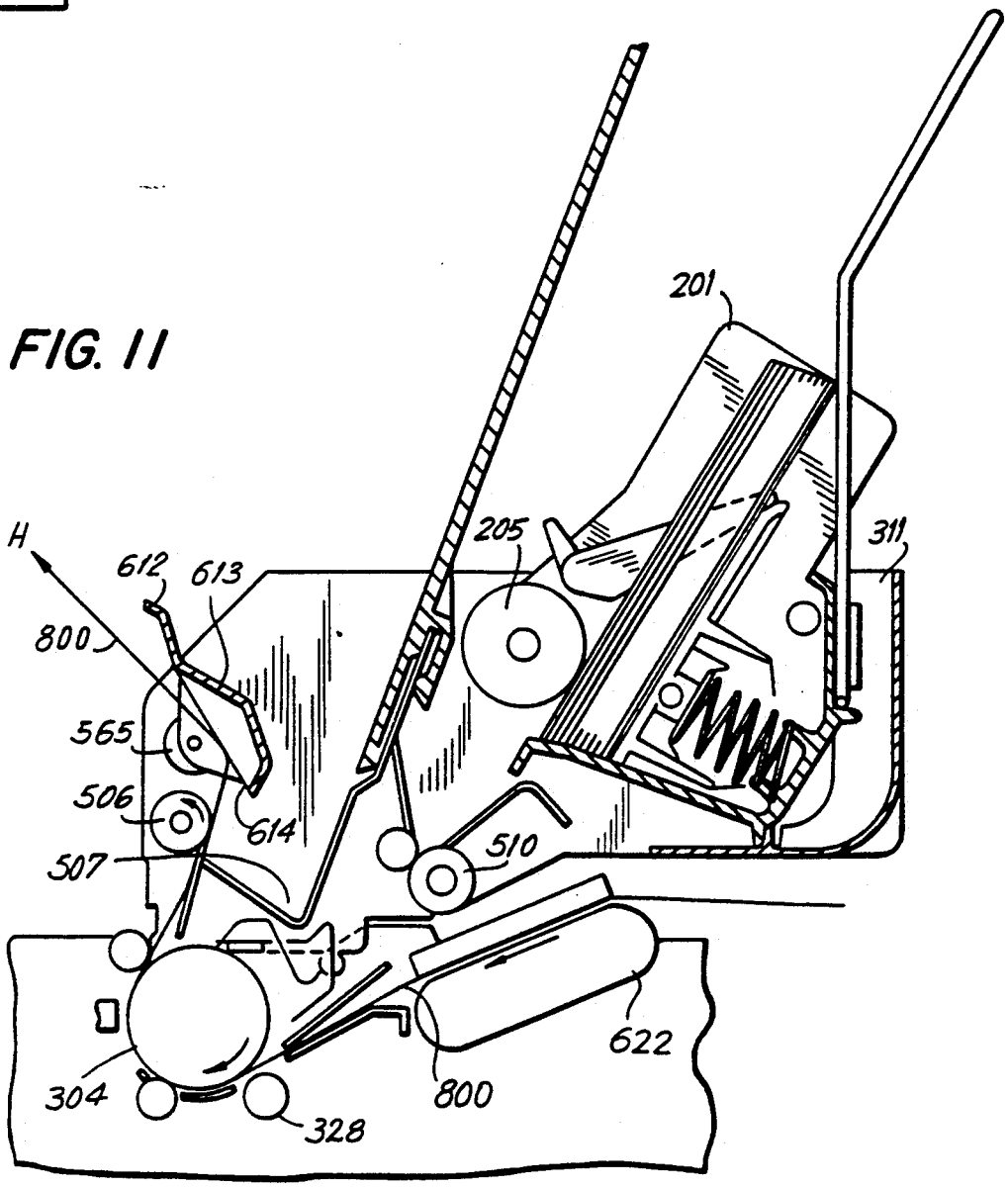
FIG. 11 is a diagrammatic side elevational view, partially in cross section, of FIG. 1 illustrating the path of travel by a continuous sheet of paper through the printer and paper feeding apparatus.

As shown in FIGS. 10 and 11, paper feed-out guide 612 can be locked into a second position by rotating guide 612 about arm 590 with circular protrusion 595 serving as a stop. Ribs 613 are now properly aligned for guiding the discharge of fanfold paper 800 from printer 700. For example, when a continuous sheet of paper 800 is fed from tractor 622 and advanced through printer 700 by platen 304 and paper feed-out roller 506, an end face 614 of each rib 613 will guide the discharge of paper 800 in an upwardly direction denoted by an arrow H. Paper 800 is directed away from printer 700 and is not stored within storage section 507.

Fanfold paper such as paper 800 and cut sheets of recording media such as paper 121 can be easily separated from each other by merely rotating paper feed-out guide 612 to the positions shown in FIGS. 10 and 9, respectively. Furthermore, as shown in FIG. 6 with paper feed-out guide 612 positioned so as to direct cut sheets of recording media into storage section 507, paper feed-out guide 612 also serves as a cover to protect paper feed roller 506.

As now can be readily appreciated, paper feeding apparatus 200 provides for feeding comparatively short lengths of paper around platen 304 through auxiliary paper feed rollers 510. To achieve this desired advantage, auxiliary paper feed rollers 510 are positioned between paper feed rollers 205 and platen 304 and rotate in a counterclockwise direction irrespective of the direction in which platen 304 rotates. Additionally, the sheet of recording media to be printed on can be properly aligned on platen 304 by platen 304 momentarily rotating in a counterclockwise direction just prior to the sheet of recording medium being advanced between platen 304 and paper feed roller 328.

Release lever 313 can be pivoted to transmit power from motor 400 to paper feed rollers 205 and auxiliary paper feed rollers 510 or to disengage the transmission of such power. By disengagement of such power to transmission mechanism 300, fanfold paper can be fed into platen 304.

Transmission mechanism 300 provides for rotating paper feed rollers 205 in only a clockwise direction and only when platen 304 rotates in a counterclockwise direction. Consequently, where platen 304 is rotated in a clockwise direction, transmission mechanism 300 disengages paper feed rollers 205.

Paper feeding apparatus 200 is well situated to separate the top sheet of paper, envelope, postcard or the like from the remaining stack of recording media stored within hoppers 201. Various thicknesses of recording media can be accommodated by apparatus 200 without the need for further attachments as presently required by conventional paper feeding devices.

Paper feed-out guide 612 is positioned at the discharge port of printer 700 to separate and guide in different directions different types of recording media. Paper feed-out guide 612 also serves as a protection cover for paper feed-out roller 506 when cut-sheets of recording medium are advanced by roller 506 to storage section 507.

It will thus be seen that the objects set forth above, and those made apparent from the preceding description are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A paper feeding apparatus associated with a printer having a platen, comprising:
   - driving means for rotating the platen in first and second directions;
   - storage means for holding a plurality of individual recording media and including separating means for controlling the release of individual recording media from the storage means;
   - roller means for removing individual recording media from the storage means;
   - auxiliary roller means disposed along a path travelled by the individual recording media and between the roller means and platen for advancing the individual recording media towards the platen; and
   - transmission means for rotating said roller means to remove individual recording media from the storage means in response to rotation of said platen in the first direction and for rotating said auxiliary roller means to advance the recording media in response to rotation of said platen in the first and second directions;
   - wherein said auxiliary roller means rotates in only one direction in response to rotation of said platen in first and second directions.

2. The paper feeding apparatus of claim 1, wherein the auxiliary roller means includes at least two rollers between which said individual recording media travels.

3. The paper feeding apparatus of claim 1, wherein the storage means further include compression spring coil means for biasing the plate means.

4. The paper feeding apparatus of claim 1, wherein said separating means include beveled surfaces on the storage means.

5. The paper feeding apparatus of claim 4, wherein said separating means further includes claw means adjacent to the beveled surfaces and connected to the storage means.

6. The paper feeding apparatus of claim 1, wherein the storage means include plate means biased towards said roller means for supporting said recording media.

7. The paper feeding apparatus of claim 6, wherein the storage means further include hopper means for slidably supporting the plate means.

8. The paper feeding apparatus of claim 7, wherein the storage means further include rotatable arm means for exerting pressure in a direction towards the plate means.

9. The paper feeding apparatus of claim 8, wherein the storage means further include stopper means for preventing the arm means from exerting pressure in a direction towards the plate means.

10. The paper feeding apparatus of claim 9, wherein the stopper means include bar means slidably connected to said hopper means for intersecting the path along which said arm means travels.

11. The paper feeding apparatus of claim 10, wherein the auxiliary roller means includes at least two rollers between which said individual recording media travels.

12. The paper feed apparatus of claim 1, wherein said transmission means include release lever means for preventing and permitting rotation of said roller means and said auxiliary roller means.

13. The paper feeding apparatus of claim 12, further including tractor means for providing continuous print media about said platen in response to said release lever preventing rotation of said roller means and said auxiliary roller means.

14. The paper feeding apparatus of claim 13, wherein the transmission means further includes a plurality of gear means for coupling the rotary motion of said platen to said roller means and auxiliary roller means.

15. The paper feeding apparatus of claim 14, further including adjusting lever means responsive to the position of said release lever means for adjusting the position of at least one of said gear means to selectably couple and decouple the transmission of rotary motion of said platen to said roller means and auxiliary roller means.

16. The paper feeding apparatus of claim 15, wherein the auxiliary roller means includes at least two rollers between which said individual recording media travels.

17. The paper feeding apparatus of claim 13, further including at least one feed-out roller and feed-out guide means for guiding the discharge of the individual recording media and fanhold paper in different directions.

18. The paper feeding apparatus of claim 17, wherein the feed-out guide means includes locking means for rotatably locking the feed-out guide means into positions associated with the different directions along which the individual recording media and fanfold paper are discharged.

19. The paper feeding apparatus of claim 18, wherein the feed-out guide means includes a plurality of ribs for controlling the path along which the fanfold paper is discharged from the printer.

20. The paper feeding apparatus of claim 18, wherein the feed-out guide means serves as a cover for the at least one feed-out roller.

21. A paper feeding apparatus associated with a printer having a platen, comprising:

motor means for rotating the platen in first and second directions;

storage means for holding a plurality of individual recording media and including plate means for supporting said recording media, hopper means for supporting the plate means and separating means for controlling the release of individual recording media from the storage means, said separating means including a pair of claws and a beveled surface;

roller means for removing individual recording media from the storage means and disposed adjacent to the pair of claws and beveled surface;

auxiliary roller means disposed along a path travelled by the individual recording media and between the roller means and platen for advancing the individual recording media towards the platen; and transmission means for rotating the roller means to remove individual recording media from the storage means in response to rotation of the platen in the first direction and for rotating the auxiliary roller means to advance the recording media in response to rotation of the platen in the first and second directions, said transmission means including a plurality of gear means for coupling the rotary motion of the platen to the roller means and auxiliary roller means and release lever means for causing the repositioning of one or more gear means to decouple the rotary motion of the platen to the roller means and auxiliary roller means;

wherein said storage means further includes spring means for biasing the plate means towards said roller means, rotatable arm means for exerting pressure in a direction towards the plate means, and stopper means for preventing the arm means from exerting pressure on the plate means and wherein said auxiliary roller means rotates in only one direction in response to rotation of said platen in first and second direction.

22. A method for feeding individual recording media and fanfold paper to a platen of a printer, comprising:

storing a plurality of individual recording media in a storage device;

rotating the platen in a first direction;

transmitting a driving force based on the rotary motion of the platen to rotate at least one paper feed roller to remove individual recording media from the storage device;

rotating the platen in a direction opposite to said first direction to remove the driving force applied to at least one paper feed roller; and transmitting the rotary motions of the platen in said first and opposite directions to at least one auxiliary paper feed roller to rotate the at least one auxiliary paper feed roller for advancing the individual recording media toward the platen wherein the at least one auxiliary paper feed roller rotates in the same direction regardless of the direction in which said platen rotates.

23. The method of claim 22, wherein the first direction is a counterclockwise direction and the second direction is a clockwise direction.

24. The method of claim 23, wherein said platen is rotated in a counterclockwise direction until one of said individual recording media reaches said at least one auxiliary paper feed roller.

25. The method of claim 24, further including rotating said platen in a clockwise direction once one of said individual recording media reaches said at least one auxiliary paper feed roller.

26. The method of claim 25, further including rotating the platen in a counterclockwise direction as a leading edge of the individual recording media reaches said platen whereby the leading edge is positioned parallel to the longitudinal direction of said platen.

27. The method of claim 25, further including rotating the platen in a counterclockwise direction as a leading edge of the individual recording media is disposed proximate to the platen whereby the leading edge is bent by the platen to properly position the recording media on the platen.

28. A paper feeding apparatus associated with a printer, comprising:

a platen;

driving means for rotating said platen in forward and backward directions;

storage means for storing a stack of cut sheets and including separating means operable for separating the stack of cut sheets one sheet at a time;

roller means for removing individual cut sheets from said storage means;

auxiliary roller means disposed along a path travelled by said cut sheets between said platen and roller means for feeding said platen with said cut sheets; and transmission means coupled to said driving means for rotating said roller means and said auxiliary roller means for advancing said cut sheets toward said platen when said platen rotates in a backward direction and for rotating said auxiliary roller means for further advancing said cut sheets toward said platen when said platen rotates in a forward direction;

wherein said auxiliary roller means rotates in only one direction regardless of the direction in which said platen rotates.

29. A paper feeding apparatus for supplying cut sheets and fanfold paper to a printer, comprising:

a rotatably supported platen;

fanfold paper feeding means for feeding said platen with said fanfold paper;

storage means for storing a stack of cut sheets and including separating means operable for separating the stack of cut sheets one sheet at a time;

roller means for feeding said platen with individual cut sheets;

means for generating power to drive said platen and fanfold paper feeding means;

transmission means operable for transmitting the generated power to said fanfold paper feeding means so that said fanfold paper feeding means feeds said platen with said fanfold paper and for transmitting the generated power to said roller means so that said roller means feeds said platen with said cut sheets when said platen rotates in both forward and backward directions; and control means for redirection the transmission of the generated power such that said roller means and said fanfold paper feeding means are prevented from receiving the generated power at the same time.

30. The paper feeding apparatus of claim 29, wherein said fanfold paper feeding means is positioned substantially parallel to said platen and said storage means is positioned above said fanfold paper feeding means.

* * * * *